US007462769B2

(12) United States Patent
Kilpatrick

(10) Patent No.: US 7,462,769 B2
(45) Date of Patent: Dec. 9, 2008

(54) PROTECTIVE HEADSTOCK COVER

(76) Inventor: Christopher Jon Kilpatrick, 9 Wickland, Irvine, CA (US) 92620

( * ) Notice: Subject to any disclaimer, the term of this patent is extended or adjusted under 35 U.S.C. 154(b) by 0 days.

(21) Appl. No.: 11/748,937

(22) Filed: May 15, 2007

(65) Prior Publication Data

US 2007/0266842 A1 Nov. 22, 2007

Related U.S. Application Data

(60) Provisional application No. 60/801,154, filed on May 17, 2006.

(51) Int. Cl.
*G10D 3/00* (2006.01)

(52) U.S. Cl. ..... 84/329

(58) Field of Classification Search ..... 84/291, 84/327, 329, 290

See application file for complete search history.

(56) References Cited

U.S. PATENT DOCUMENTS 6,911,590 B2 * 6/2005 Childress ..... 84/291

2007/0163420 A1 * 7/2007 Reiss et al. ..... 84/329

* cited by examiner

*Primary Examiner*—Kimberly R Lockett
(74) *Attorney, Agent, or Firm*—Knobbe, Martens, Olson & Bear, LLP

(57) ABSTRACT

Embodiments of the present disclosure provide a protective barrier between a musical instrument and any potentially damaging object that may come into contact with the instrument. While disclosed generally with reference to a guitar headstock, an artisan will recognize from the disclosure herein that the protective barriers consistent with the disclosure herein may advantageously be applied to any edge or portion of any guitar, or even any edge or portion of a wide variety of other musical instruments subject to normal wear dents and dings. The protective barrier may be disposable per use, may be adapted for long term application, may comprise a pliable plastic cap, may comprise a plastic cover, may comprise multiple components, may be transparent to allow the original finish of the instrument to be visible, may be colored for aesthetic value, may be personalized, may be shaped or colored to identify association with a particular type of instrument, combinations of the same, or the like.

26 Claims, 5 Drawing Sheets

PROTECTIVE HEADSTOCK COVER

CROSS-REFERENCE TO RELATED APPLICATIONS

The present application claims priority benefit under 35 U.S.C. §119(e) to U.S. Provisional Patent Application Ser. No. 60,801,154, filed May 17, 2006, entitled Protective Headstock Cover, which is incorporated by reference herein.

FIELD OF THE DISCLOSURE

The present disclosure relates to the field of musical instruments including, without limitation, guitars, ukuleles, mandolins, violins and the like. More specifically, the disclosure relates to protecting such musical instruments from damage.

BACKGROUND OF THE DISCLOSURE

Owners of musical instruments have long struggled with the issue of protecting their valuable instruments from damage. For example, instruments are often shaped to have numerous exposed edges, many of which may sustain various dings, dents and chips from accidental contact with objects during use or when the instrument is simply set down, leaned against a wall or other object, or otherwise disposed of when not being played. With today's instruments being increasingly expensive, and some being actual investments, there is a need to protect the original shape and finish against damage generally associated with normal use.

Because of the near proclivity of hand-held instruments to attract the foregoing normal-use damage when not being played, manufacturers and after-market retailers have designed a large number of differing cases, wall-holding and instrument stand devices capable of supporting the various instrument components. These stand devices range from the mechanically simple to extraordinarily complex, with each design being an attempt to provide short or long term damage free storage during nonuse. While these devices are valuable tools used to protect instruments from damage, they are not always available, convenient or easily transported or useable during normal use and short term storage or non-use of an instrument. Thus, the problem of damage to valuable instruments remains. Moreover, this risk is virtually constant and continuous, especially when instruments include materials that are easily damaged by inadvertent contact with floors, furniture, equipment or the like.

Thus, it is likely that a musical instrument user will often find themselves desiring to set down their instrument, even if only momentarily, and not find a conveniently appropriate stand or other protective device capable of reducing wear caused by normal use.

SUMMARY OF THE DISCLOSURE

Based on at least the foregoing, a need exists for a straightforward, easily portable, protective device for reducing damaging dings and chips consistent with short and long term normal use. In an embodiment, a protective cover Is placed over some or all of the edges of an instrument such that when the instrument is leaned against or otherwise contacts an object, a contact point on the instrument is protected by the cover. For example, in the instance of a guitar headstock, a headstock cover may comprise a cap that friction fits over one or more extremities. In an embodiment, the cap may be preformed to substantially match a particular model and/or brand of instrument, may be shaped to generically fit multiple models and/or brands, or may be pliable to shape to many configurations. In an embodiment, the cap comprises a transparent plastic such that the finish of the headstock is readily viewable through the cap. In other embodiments, the cap may be colored for aesthetic value or to provide identity with a particular type or brand of instrument. In an embodiment, the cover can remain on the headstock without changing, or at least without substantively changing or impacting the musical performance of the guitar.

In some embodiments, the protective cover comprises a plastic or other type of enclosure (including without limitation, wood, metal, cardboard, glass, fabric, leather, combinations of the same, or the like) having an open side for accepting the shape of an edge of a particular brand of musical instrument. In an embodiment, the enclosure may include a pivot point capable of opening the enclosure to accept, for example, a multi-edge extremity of a headstock. Once positioned, portions of the plastic enclosure may pivot around, for example, a hinge, and snap closed over the headstock. In an embodiment, components of the plastic enclosure may include an attachment mechanism, such as, for example, a detent and catch, or the like (such as, for example, a Velcro type attachment), for releasably securing the enclosure around portions of the musical instrument. In still other embodiments, the plastic enclosure may comprise a multi-component enclosure that, for example, snaps together to form an appropriate protective cover. In still other embodiments, the enclosure may be flexible to allow the user to manually stretch it over the headstock, with the device held onto the instrument by the force of the device as it tries to return to its natural state.

In other embodiments, the device may be made to attach to any edge of an instrument that may be at risk of damage from accidental contact, such as, for example, the sides of a guitar. The protective cover could be tape or a roll of material that is cut or terminated to fit the user's particular instrument and the user's selected cite to be protected.

For purposes of summarizing the disclosure, certain aspects, advantages and novel features of the disclosure have been described herein. Of course, it is to be understood that not necessarily all such aspects, advantages or features will be embodied in any particular embodiment of the disclosure.

BRIEF DESCRIPTION OF THE DRAWINGS

The following drawings and the associated descriptions are provided to illustrate embodiments of the present disclosure and do not limit the scope of the claims.

DETAILED DESCRIPTION OF THE PREFERRED EMBODIMENT

Embodiments of the present disclosure seek to provide a protective barrier between an object against which a musical instrument may be leaned or come into contact with, and the instrument itself. While disclosed generally with reference to a guitar headstock, an artisan will recognize from the disclosure herein that the protective barriers consistent with the disclosure herein may advantageously be applied to any edge or portion of any hand-held or other instrument subject to normal wear, dents, chips and dings.

Embodiments of the protective barrier disclosed herein may be disposable per use, may be adapted for long term application, may comprise a pliable or flexible cap, may comprise a harder plastic cover, may be of any material such as, without limitation, wood, metal, plastic, cardboard, glass, fabric, leather, combinations of the same, or the like may comprise multiple components, may be transparent to allow the original finish of the guitar to be visible, may be colored, customized or personalized, may be in strip or roll form to be cut or terminated by the user, or combinations of the same or the like. It will be apparent to an artisan from the disclosure herein that a large number of different shaped protective barriers may be straightforwardly applied to, for example, the headstock of the guitar, which reduces the number of chips and dings in the finish of the guitar caused through normal use. For example, a protective cap may be stretched over one or more extremities of a headstock, thereby allowing a guitarist or other person to lean the headstock against a wall, chair, or the like, without concern for damaging the finish of the headstock or for protection against accidental contact during use with another object. Alternatively, a harder plastic cap may be hingably applied, may comprises multiple components that snap fit together, or the like in a manner that protects the guitar when leaned against a surface. In various embodiments, the protective cover may comprise a transparent material providing view of the finish of the headstock or be colored for aesthetic purposes or to identify a particular type or brand of an instrument.

Figure 1:
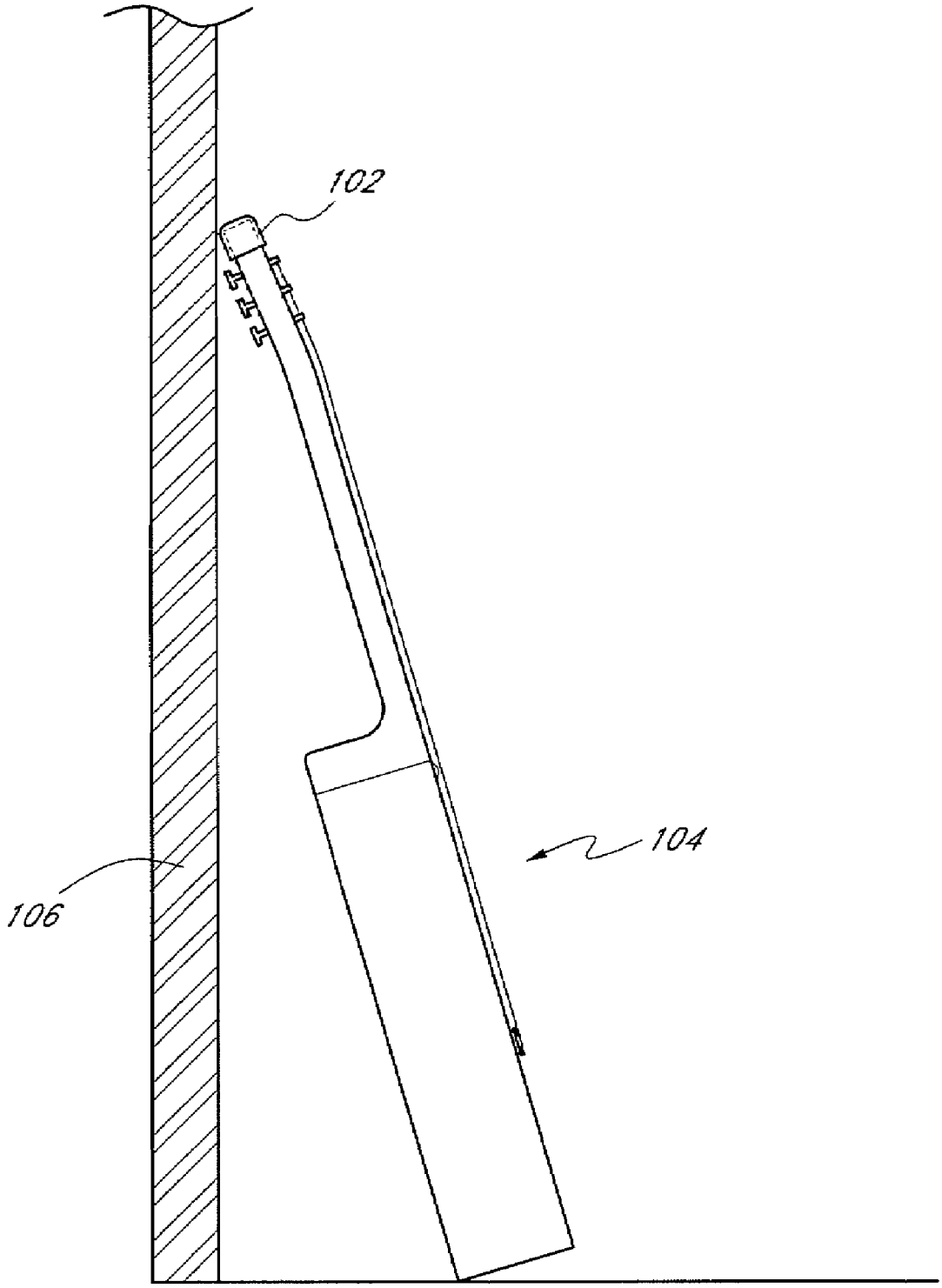
FIG. 1 illustrates a side view of an exemplary embodiment of a protective headstock cover applied to an exemplary guitar leaned against an object during nonuse.

To facilitate a complete understanding of the disclosure, the remainder of the detailed description references the drawings. Specifically, FIG. 1 illustrates a side view of an exemplary embodiment of a protective headstock cover 102 applied to an exemplary guitar 104 leaned against an object 106 during nonuse. As shown in FIG. 1, the cover 102 surrounds one or more edges or extremities of the headstock, providing a contact for balancing the guitar 104 during a period of nonuse. An artisan will recognize from the disclosure herein that wall contact, and the contact generally associated with the floor, such as, for example, an extremity of the body of the guitar, or often a pin or small protrusion from the body specifically for protecting the body of the guitar when it is set down. The cover 102 may advantageously comprise a shape and a material that is straightforwardly applied to the headstock in a disposable, semi-permanent, or even permanent manner. For example, the cover 102 may advantageously comprise a pliable plastic that can be stretched to form fit over the headstock. The cover 102 may advantageously comprise a transparent or semi-transparent material allowing visibility of the original finish of the headstock. In other embodiments, the cover 102 may advantageously be customized to a particular taste, to a particular shape, color, pattern or, material suited to protect a different portion of the instrument, or combination thereof.

In an embodiment, when the cover 102 is scratched or damaged, or a different type of embodiment is desired (e.g. a different color or material) the cover 102 is advantageously discarded and another cover could be applied.

Figure 2B:
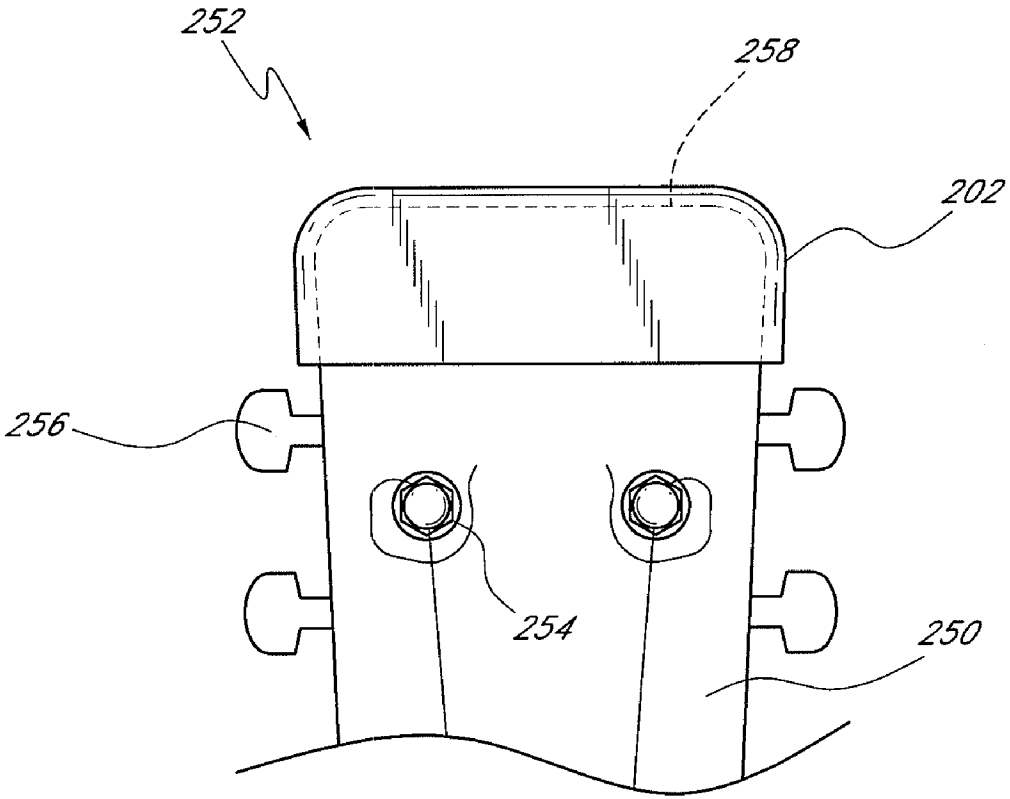
FIGS. 2B, 3B, 4B and 5B illustrate front plan views of the covers of FIGS. 2A, 3A, 4A and 5A, respectively, applied to exemplary headstocks of exemplary guitars.
Figure 2A:
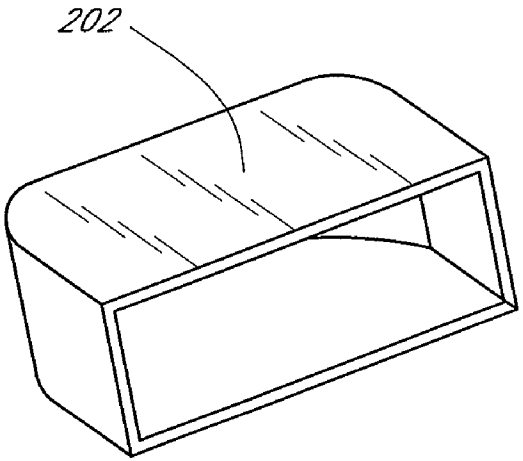
FIGS. 2A, 3A, 4A and 5A illustrate perspective views of embodiments of protective headstock covers.

FIG. 2A illustrates a front plan view of an embodiment of a protective headstock cover 202, such as, for example, the cover 102 of FIG. 1. As shown in FIG. 2A, the cover 202 comprises four sides and a top surface, forming a substantially rectangular box shape having an open side for accepting a protruding edge of a musical instrument, such as, for example, an extremity of a headstock of a guitar. The cover 202 may advantageously comprise a pliable material enabling it to stretch and pull over a particular edge. Moreover, as is recognizable to an artisan from the disclosure herein, the cover 202 may advantageously be pre-shaped or capable of shaping by the user, such as tape from a roll into a shape generic to a wide variety of headstocks, into a shape generic to a series or a plurality of series of headstocks, into a shape generic for a manufacturer or a plurality of manufactures, into a shape specific to a particular headstock, a particular instrument or instrument portion, combinations of the same or the like. Also, an artisan will recognize from the disclosure herein that the cover 202 may be shaped to account for tuning pegs, heads, gears, or the like such that the cover 202 advantageously lies flush with the finish of the headstock surface. In still other embodiments, the cover may comprise a protruding edge capable of contacting a surface before that of a guitar edge.

Although disclosed as a cap for a particular headstock, an artisan will recognize form the disclosure herein that the cover 202 may advantageously be fitted to protect a small edge, such as a single corner, curve, surface, protrusion, or the like, or be capable of protecting larger portions or surfaces, or even entire instruments.

FIG. 2B illustrates a front plan view of the cover 202 applied to an exemplary headstock 250 of an exemplary guitar 252. As shown in FIG. 2B, the headstock 250 includes tuning pegs 524 and associated gears 256 usable in a known manner to adjust the tension in the strings of the guitar 252. The headstock 250 includes extremity 258 potentially subject to the dings, scratches, dents, chips or the like from normal wear and specifically from wear associated with leaning the guitar 250 against objects or otherwise setting the guitar down during nonuse. As shown, the cover 202 has been stretched over the extremity 258 and is secured through, for example, a friction fit, such that any wear will occur to the cover 202 as opposed to the extremity 258 of the headstock 250.

Although disclosed with reference to the cover 202, an artisan will recognize from the disclosure herein a large number of shapes, materials, or the like usable to protect the extremity 258 of the headstock 250.

Figure 3B:
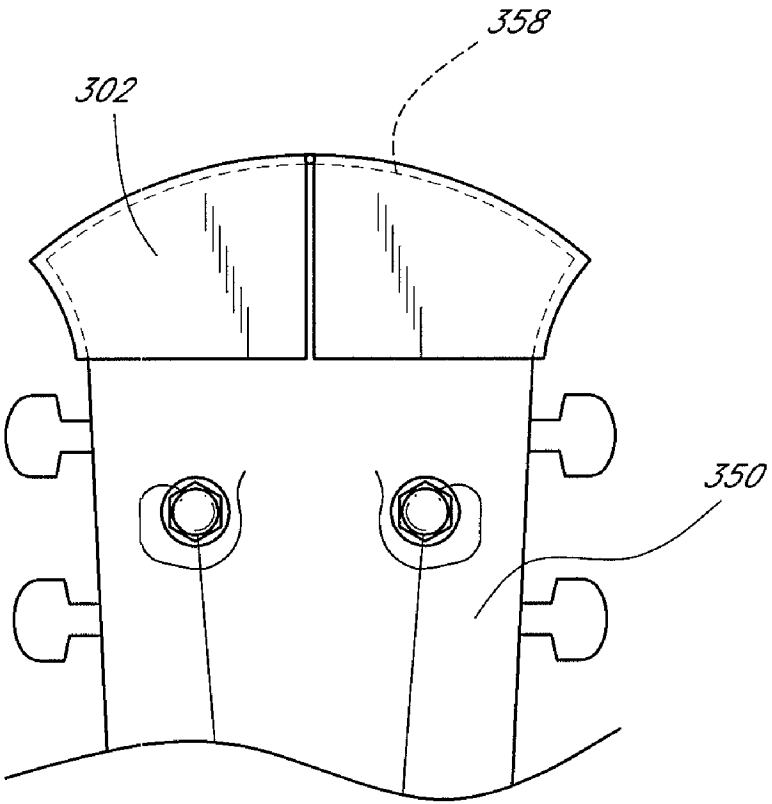
Figure 3A:
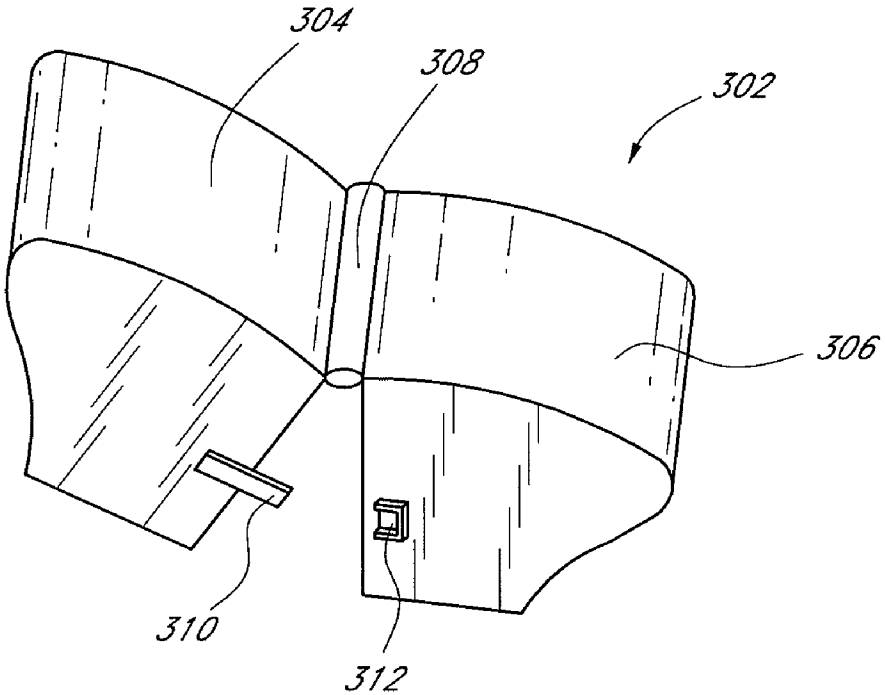

FIG. 3A illustrates a perspective view of an embodiment of a protective headstock cover 302. As shown in FIG. 3A, the cover 302 comprises first and second components 304, 306, connected through a pivot mechanism 308, such as, for example, a hinge. The cover 302 may advantageously comprise a hard plastic or other protective material where first and second components 304, 306, pivot around the pivot mechanism 308 to accept one or more protruding edges of a musical instrument, such as, for example, an extremity of a headstock of a guitar. The cover 302 may advantageously include an attachment mechanism, which in at least one embodiment releasably secures the first and second components 304, 306 together. As shown in FIG. 3A, the attachment mechanism may include a detent 310 and corresponding catch 312. In an embodiment, the cover 302 may include the attachment mechanism on two or more surfaces of the cover 302. Furthermore, an artisan will recognize a wide variety of attachment devices suitable for securing the components to the headstock, including for example hook-and-loop materials, snaps, buckles, bumps, Velcro or the like.

FIG. 3B illustrates a front plan view of the cover 302 applied to an exemplary headstock 350 of an exemplary guitar 352. As shown in FIG. 3B, the cover 302 has been closed around an extremity 358 of the headstock 350 by pivoting along the hinge and has been releasably secured by the attachment mechanism such that any wear or contact damage will occur to the cover 302 as opposed to the extremity 358 of the headstock 350.

Although disclosed with reference to a two-piece cover 302, an artisan will recognize from the disclosure herein a large number of shapes, materials, or the like usable to protect the extremity 358 of the headstock 350.

Figure 4B:
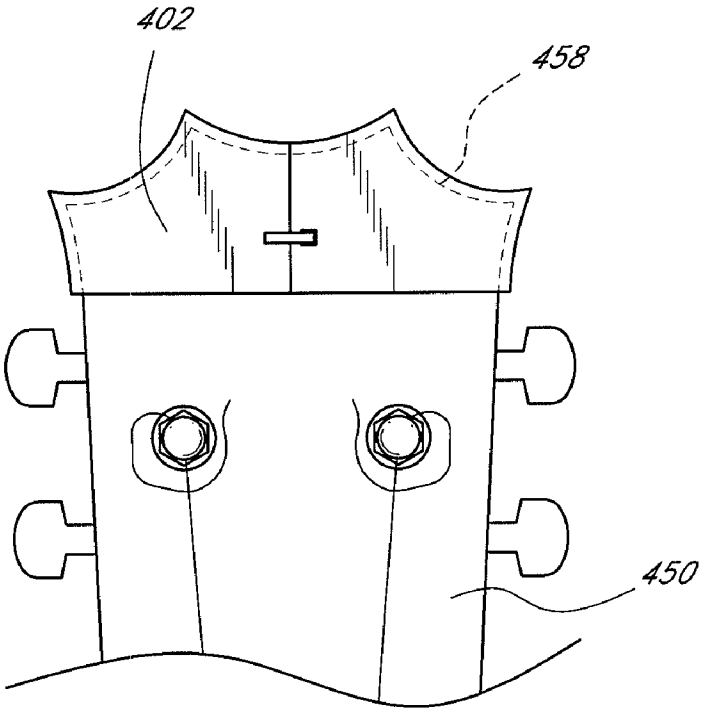
Figure 4A:
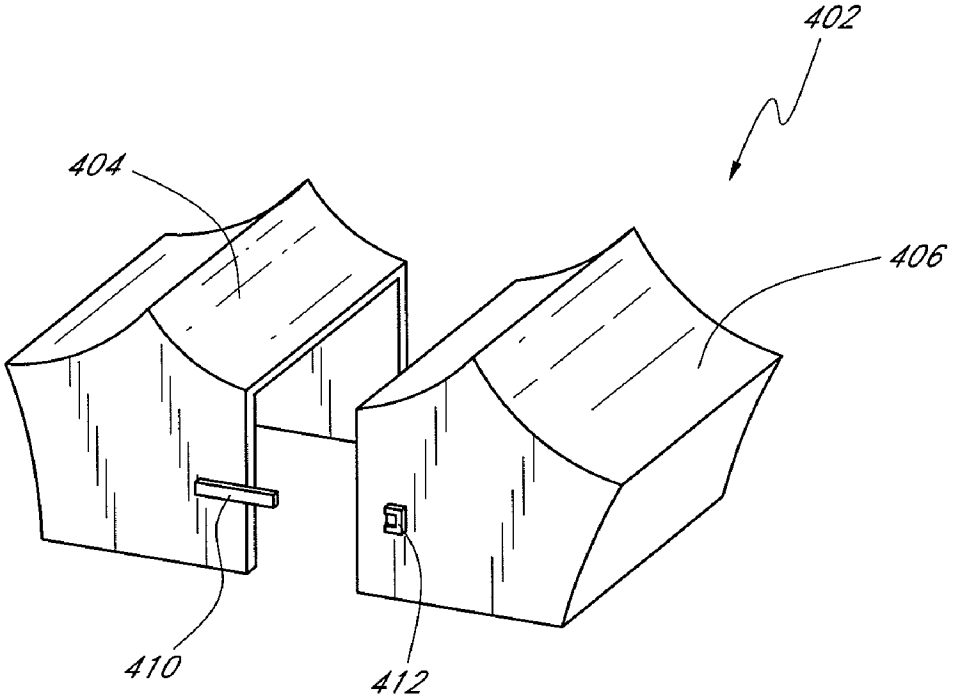

FIG. 4A illustrates a perspective view of an embodiment of a protective headstock cover 402. As shown in FIG. 4A, the cover 402 comprises first and second components 404, 406, connected through an attachment mechanism, which in at least one embodiment releasably secures the first and second components 404, 406 together. Similar to FIGS. 3A-3B, the cover 402 may advantageously comprise a hard plastic material. The first and second components 404, 406, separate to accept one or more, preferably multiple, protruding edges of a musical instrument. Also similar to FIGS. 3A-3B, the attachment mechanism may include a detent 410 and corresponding catch 412. In an embodiment, the cover 402 may include the attachment mechanism on multiple surfaces of the cover 402 in order to provide a secure fit over any protruding edges of the instrument.

FIG. 4B illustrates a front plan view of the cover 402 applied to an exemplary headstock 450 of an exemplary guitar 452. As shown in FIG. 4B, the cover 402 has been closed around an extremity 458 of the headstock 450 by sliding the first and second components 404, 406, toward one another until the attachment mechanism secures the components 404, 406, together. Once applied to the instruments, wear will occur to the cover 402 as opposed to the extremity 458 of the headstock 450.

Although disclosed with reference to the cover 402, an artisan will recognize from the disclosure herein a large number of shapes, materials, or the like usable to protect the extremity 458.

Figure 5B:
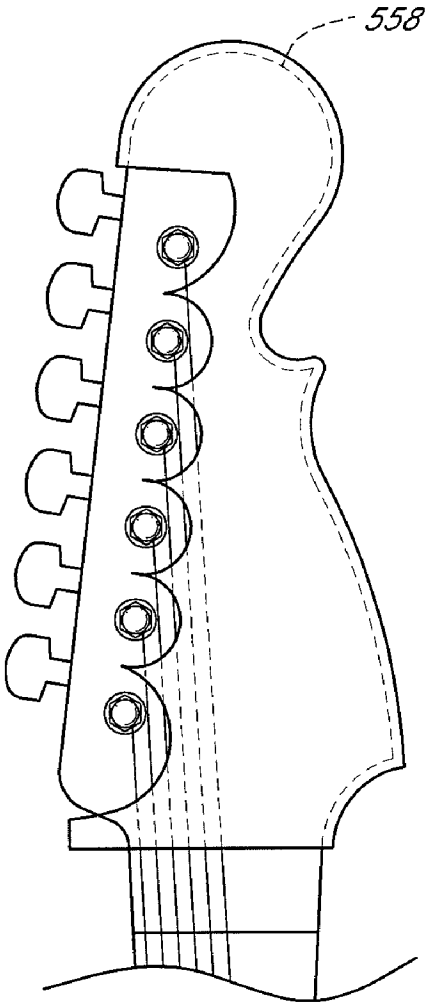
Figure 5A:
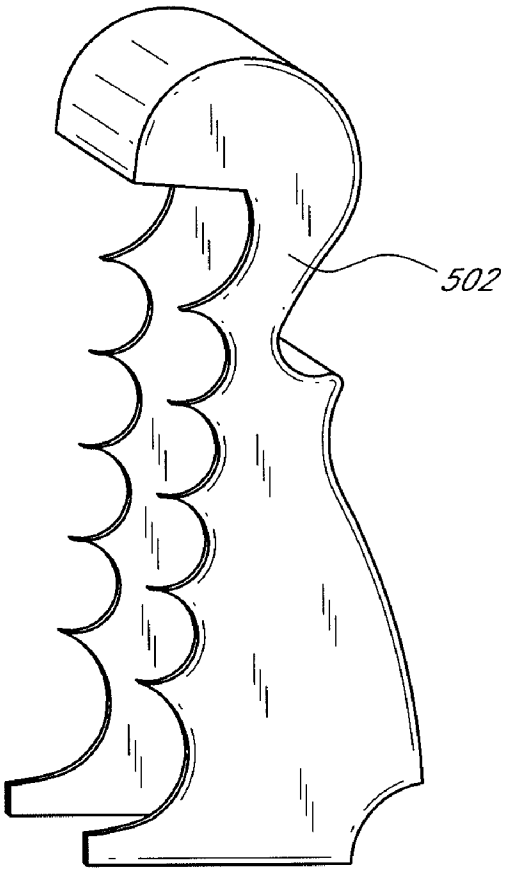

FIG. 5A illustrates a perspective view of an embodiment of a protective headstock cover 502. As shown in FIG. 5A, the cover 502 comprises a shape having a closed end 504 and an open end 506. The cover 502 is also advantageously shaped to account for, for example, for tuning pegs, heads, gears, or the like such that the cover 502 advantageously lies flush with the finish of the instrument surface. FIG. 5A also shows a plurality of attachment mechanisms 508, comprising in this embodiment straps with snaps. The cover 502 may advantageously comprise a hard plastic material.

FIG. 5B illustrates a front plan view of the cover 502 applied to an exemplary headstock 550 of an exemplary guitar 552. As shown in FIG. 5B, the cover 502 accepted extremities 558 of the headstock 550 from one side and secured through use of the straps. Also similar FIGS. 3A-4B, any wear on the extremities 558 of the guitar 552 will occur to the cover 502 as opposed to the extremity 558 of the headstock 350.

Although disclosed with reference to the cover 502, an artisan will recognize from the disclosure herein a large number of shapes, materials, or the like usable to protect the extremity 558, or any other portion, edge, surface, or the like.

Although the foregoing disclosure has been described in terms of certain preferred and alternative embodiments, other embodiments will be apparent to those of ordinary skill in the art from the disclosure herein. Moreover, an artisan will recognize from the disclosure herein that features and advantages disclosed with respect to any individual embodiment may be applied individually or in any combination to that disclosed embodiment or any other embodiment disclosed or recognizable by the artisan.

Additionally, other combinations, omissions, substitutions and modifications will be apparent to the artisan from the disclosure herein. Accordingly, the present disclosure is not limited by the reaction of the preferred embodiments, but is to be defined by reference to the appended claims.

Additionally, all publications, patents, and patent applications mentioned in this specification are herein incorporated by reference to the same extent as if each individual publication, patent, or patent application was specifically and individually indicated to be incorporated by reference.

What is claimed is:

1. A protective barrier applied to an assembled, playable, and tunable musical instrument to reduce or prevent damage from contact with other objects, the protective barrier comprising a pliable cap including a front and at least one side, the pliable cap configured to be stretched over one or more extremities of the assembled, playable, and tunable musical instrument to form a friction fit between the front and the at least one side of the cap and at least some surfaces of the one or more extremities of the musical instrument, wherein after application, wear or contact damage normally occurring to the at least some surfaces of the one or more extremities occurs to or is at least partially absorbed by the pliable cap.

2. The protective barrier of claim 1, wherein the pliable cap is removable.

3. The protective barrier of claim 1, wherein the pliable cap is disposable.

4. The protective barrier of claim 1, wherein the pliable cap is semi-permanent.

5. The protective barrier of claim 1, wherein the pliable cap at least partially adhesively applied to the musical instrument.

6. The protective barrier of claim 1, wherein the instrument comprises a guitar, and wherein the extremities comprise extremities of a headstock of the guitar.

7. The protective barrier of claim 6, wherein the pliable cap is shaped to account for tensions mechanisms associated with the headstock of the guitar, said pliable cap allowing the tensions mechanisms to be adjustable after the pliable cap is applied.

8. The protective barrier of claim 6, wherein the pliable cap is pre-shaped to resemble the extremities of the headstock.

9. The protective barrier of claim 6, wherein the pliable cap is flexible and capable of being stretched to fit the extremities of the headstock.

10. The protective barrier of claim 1, wherein the pliable cap comprises a transparent material.

11. The protective barrier of claim 1, wherein the pliable cap comprises at least one of colors, images, and designs.

12. A protective barrier applied to a musical instrument to reduce or prevent damage from contact with other objects, the protective barrier comprising:

at least one component shaped to generally resemble at least a portion of an assembled musical instrument, the component shaped in more than a single plane; and an attachment mechanism configured to attach the at least one component to a multi-plane portion of the musical instrument where wear or damage normally occurring to surfaces of the multiple planes of the musical instrument occurs or is at least partially absorbed by the at least one component, wherein when the musical instrument remains playable and tunable after protective barrier is applied thereto.

13. The protective barrier of claim 12, wherein the at least one component comprises at least one of a hard plastic material, a metal, a cardboard material, a wrap material, a tape material, a disposable material, and a semi-permanent material.

14. The protective barrier of claim 12, further comprising a pivot mechanism.

15. The protective barrier of claim 12, wherein the musical instrument comprises a guitar and wherein surfaces comprise extremities of the headstock of the guitar.

16. The protective barrier of claim 12, wherein the musical instrument comprises at least one of a guitar, a ukulele, a mandolin, a violin, a piano, and a banjo.

17. The protective barrier of claim 12, wherein the at least one component comprises a transparent material.

18. An assembled, playable, and tunable musical instrument comprising:

a body;

a neck;

a headstock cooperating with the neck and body to form an assembled tunable instrument, said headstock including a plurality of edges capable of being damaged through contact with another object; and a protective cover covering at least portions of the plurality of edge of the headstock, the instrument remaining assembled and said headstock remaining tunable with said cover applied to said at least said portions of said headstock.

19. The musical instrument of claim 18, wherein the protective cover comprises a pliable cap.

20. The musical instrument of claim 18, wherein the protective cover comprises a multi-component cover.

21. The protective barrier of claim 1, wherein the pliable cap comprises a back.

22. The protective barrier of claim 21, wherein the front of said pliable cap comprises at least a front edge, wherein the back of said pliable cap comprises at least a back edge, said front edge and said back edge connected by at least one side, said at least one side comprising one of a top and either side.

23. The protective barrier of claim 12, wherein the at least one component comprises a cover including at least a front edge and another edge.

24. The protective barrier of claim 12, wherein the at least one component comprises a cover including at least a back edge and another edge.

25. The protective barrier of claim 12, wherein the at least one component comprises a cover including a front edge and a back edge.

26. The musical instrument of claim 18, wherein the protective cover comprises at least an edge liner lining at least the plurality of edges of the headstock.

* * * * *

UNITED STATES PATENT AND TRADEMARK OFFICE

CERTIFICATE OF CORRECTION

PATENT NO. : 7,462,769 B2
APPLICATION NO. : 11/748937
DATED : December 9, 2008
INVENTOR(S) : Christopher Jon Kilpatrick It is certified that error appears in the above-identified patent and that said Letters Patent is hereby corrected as shown below:

Column 1, line 59, change “Is” to --is--.

Column 7, line 12 claim 18, change “edges” to --edge--.

Signed and Sealed this

Thirtieth Day of June, 2009

JOHN DOLL
*Acting Director of the United States Patent and Trademark Office*